United States Patent [19]

Rumbaugh

[11] Patent Number: 4,781,607

[45] Date of Patent: Nov. 1, 1988

[54] ELECTRICAL CONNECTOR ASSEMBLY

[75] Inventor: William D. Rumbaugh, Carrollton, Tex.

[73] Assignee: Otis Engineering Corporation, Dallas, Tex.

[21] Appl. No.: 50,315

[22] Filed: May 14, 1987

Related U.S. Application Data

[62] Division of Ser. No. 737,825, May 24, 1985, Pat. No. 4,667,736.

[51] Int. Cl.[4] ..... H01R 3/00

[52] U.S. Cl. ..... 439/191; 439/827

[58] Field of Search ..... 439/827, 190, 191, 194, 439/195

[56] References Cited

U.S. PATENT DOCUMENTS

| | | | |
|---|---|---|---|
| 3,753,206 | 8/1973 | Busuttil et al. | 439/194 |
| 4,082,410 | 4/1978 | Storck et al. | 439/827 |
| 4,117,287 | 9/1978 | Walker et al. | 439/191 |
| 4,496,203 | 1/1985 | Meadows | 439/195 |
| 4,537,457 | 8/1985 | Davis, Jr. et al. | 439/190 |

*Primary Examiner*—J. Patrick McQuade

*Attorney, Agent, or Firm*—Johnson & Swanson

[57] ABSTRACT

A pilot valve system including an electrical connector assembly for a subsurface safety valve operated by control fluid pressure from the surface including a pilot valve connected with the control fluid line to the subsurface safety valve and into the well production string immediately above the safety valve to bypass the control fluid pressure directly into the tubing string and dump the control fluid pressure from the subsurface safety valve into the tubing string directly above the valve to minimize the time delay between control fluid pressure reduction and the safety valve closure. The electrical connector assembly includes a male plug assembly for connection on the pilot valve and a female plug assembly mounted in a side pocket mandrel for the pilot valve, such plug assemblies including annular spaced insulated connector rings in the side pocket mandrel and annular spaced insulated spring-type conductors on the male plug assembly for engaging the female plug assembly connector rings when the pilot valve is installed in the side pocket mandrel. Also disclosed is a minimum backlash latch assembly for releasably locking the pilot valve, or other well tools, along a well bore in a receptacle such as a side pocket mandrel.

4 Claims, 8 Drawing Sheets

ELECTRICAL CONNECTOR ASSEMBLY

This is a division of application Ser. No. 737,825, filed May 24, 1985, now U.S. Pat. No. 4,667,736.

BACKGROUND OF THE INVENTION

1. Field of the Invention

This invention relates to electrical connector particularly useful in subsurface tools wells, such as oil and gas wells. More specifically, the invention relates to electrical connectors for removable well tools.

2. History of the Prior Art

It is well known to use subsurface safety valves for control of fluid flow such as oil and gas in a tubing string in a well bore. Such a subsurface safety valve of the wireline retrievable type is illustrated and described in U.S. Pat. No. 3,703,193 issued Nov. 21, 1972. The safety valve shown in such patent has a hydraulically operated piston for holding the valve open in response to hydraulic fluid pressure conducted to the valve through a control fluid conductor extending to the surface end of the well bore. It will be obvious that for the operator piston of such a subsurface safety valve to move upwardly for closing the valve, the piston must raise a column of control fluid equal to the distance between the subsurface safety valve and the surface end of the well bore. Substantial time can be involved in the closure of such a subsurface safety valve due to this column of control fluid. One solution to the problem of the time delay required for the subsurface safety valve to react against the column of control fluid has been the use of a pilot valve connected downhole near the subsurface safety valve between the source of control fluid pressure and the safety valve, for shutting off the control fluid pressure to the valve and releasing the control fluid pressure in the safety valve into the tubing string immediately above the safety valve, thus, eliminating the need for the safety valve piston to lift the column of control fluid between the safety valve and the surface. Such a pilot valve is illustrated and described in U.S. Pat. No. 4,119,146 issued Oct. 10, 1978. The pilot valve shown in U.S. Pat. No. 4,119,146, is hydraulically operated and responds to a change in the control fluid pressure. Thus, the resonse time of the pilot valve is necessarily long because of the time required for a hydraulic pressure signal change to travel from the surface to the pilot valve and because the valve must lift the column of hydraulic control fluid a short distance upwardly to move from a first lower position to a second upper position for shutting off control fluid pressure to the safety valve and releasing the safety valve control fluid pressure into the tubing string above the safety valve. Also, the pilot valve of U.S. Pat. No. 4,119,146 does not open the control fluid line to the surface into the tubing string. Often subsurface safety valves are located at depths of several thousand feet in a well bore. Thus, the time for even a pilot operated subsurface safety valve located at a depth of several thousand feet to react to a change in control fluid pressure can be substantial even in the case of a pilot valve which releases the control fluid pressure into the tubing string.

SUMMARY OF THE INVENTION

It is an object of the invention to provide a pilot valve for subsurface safety valve of the character described which is responsive to electrical signals transmitted from a remote location.

It is another object of the invention to provide a pilot operated subsurface safety valve which is operated from a remote location independently of control fluid pressure communicated to the safety valve from the surface.

It is another object of the invention to provide a pilot valve for controlling a subsurface safety valve which reacts more quickly to close the safety valve than presently known subsurface safety valve control systems.

It is another object of the invention to provide an electrical connector assembly for removeable downhole well tools.

In accordance with the invention, there is provided an electrical connector for removeable well tools including longitudinally spaced annular conductors mounted in a downhole housing, insulators between the annular conductors, electrical wires leading to the annular conductors, spring type contact rings on a removeable well tool insertable into the annular conductors and spaced to engage the annular conductors, insulators between the contact rings, and electrical wires leading to the contact rings.

BRIEF DESCRIPTION OF THE DRAWING

The foregoing objects and advantages of the present invention together with the details of preferred embodiments thereof will be better understood from the following detailed description in conjunction with the accompanying drawing wherein.

DETAILED DESCRIPTION OF THE PREFERRED EMBODIMENT

Figure 1:
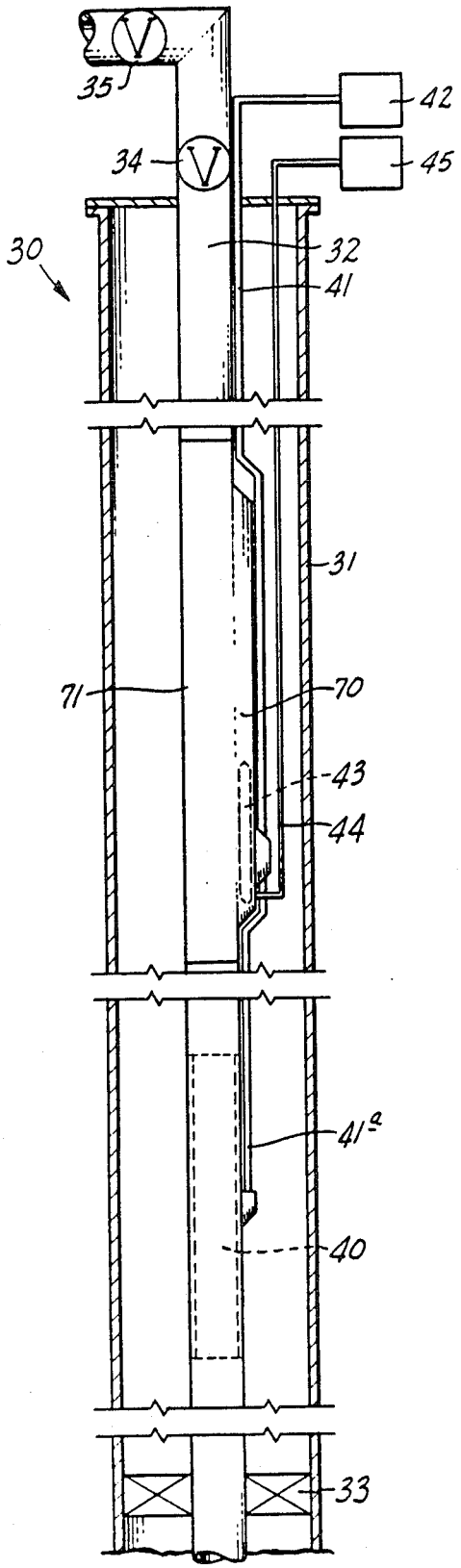
FIG. 1 is schematic longitudinal side view in elevation and section of a well installation including a subsurface safety valve and a pilot valve for controlling the safety valve.

FIG. 1, shows a well installation including a valve system including an electrical connector assembly embodying the features of the invention. As illustrated, a well 30 is cased with a string of casing 31 in which a string of production tubing 32 is supported through a well packer 33 sealing the annulus between the tubing and the casing above a producing formation, not shown. Flow through the producing string is controlled by valves 34 and 35. A subsurface safety valve 40 is installed in the production string for shutting off the fluid flow responsive to control fluid pressure communicated to the safety valve through a line 41 extending to a control fluid operating manifold 42 at the surface. In accordance with the invention, the control fluid line 41 is connected with the safety valve 40 and a pilot valve 43 which releases control fluid pressure to the safety valve while dumping the control fluid pressure into the tubing 32 above the safety valve in response to an electrical signal communicated through a cable 44 to the pilot by an electrical connector assembly from a surface power unit 45 which may be operator controlled or respond to a variety of safety conditions such fire, flow line rupture, and the like. The electrical control of the pilot valve provides substantially quicker response and a closing of the subsurface safety valve than conventional subsurface safety valves which react to a reduction of control fluid pressure through the line 41. The electrically operated pilot valve 43 responds instantly to a signal through the line 44 opening the portion of the control fluid line 41 between the pilot valve and the safety valve 40 releasing the control fluid pressure in that short section of the line into the tubing 32 so that the subsurface safety valve closes essentially instantly. The electrically operated pilot valve does not have to wait for the pressure reduction signal to travel from the surface and does not have to lift the full column of control fluid between the safety valve and the surface for the safety valve to close.

Figure 2:
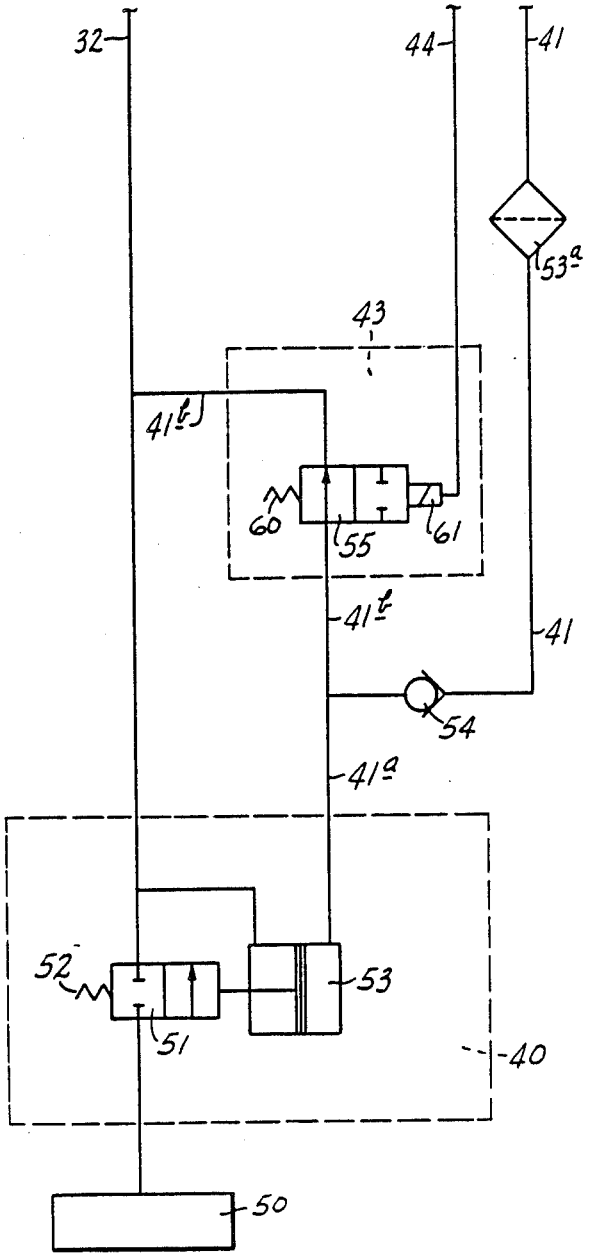
FIG. 2 is a schematic diagram of the electrohydraulic subsurface safety valve system shown in FIG. 1.

The relationship between the pilot valve 43 and the subsurface safety valve 40 is schematically illustrated in FIG. 2. Well fluids from the formation 50 below the packer 33 flow in the production tubing string 32 to the surface through the valve assembly 51 of the subsurface safety valve. The valve assembly 51 is biased closed by a spring 52 and is held open by control fluid pressure in a cylinder assembly 53 communicated to the safety valve through the control fluid line 41. The control line 41 includes a filter 53*a* and a check valve 54. The control line 41 splits into branch lines 41*a* leading to the subsurface safety valve control cylinder 53 and branch line 41*b* connected into the tubing string 32 above the safety valve through a valve assembly 55 of the pilot valve 43. The valve assembly 55 includes a spring 60 biasing the pilot valve open and a solenoid 61 connected with the electric line 44 to the surface. The solenoid 61 closes the pilot valve when energized. During the operation of the well installation of FIG. 1 and when well fluid flow through the safety valve 40 to the surface through the tubing string 32 is desired, control fluid pressure is provided from the manifold 42 through the line 41, through the filter 53*a* and the check valve 54, into the branch line 41*a* to the safety valve control cylinder 53. The piston in the cylinder assembly 53 is urged to the left against the spring 52 opening the safety valve for fluid flow from the formation 50 upwardly through the production string 32 to the surface. The solenoid 61 of the pilot valve is energized from the surface unit 45 through the electrical line 44 shifting the pilot valve assembly 55 to the left closed position against the spring 60 so that control fluid pressure from the line 41 cannot flow upwardly in the branch line 41*b*. When it is desired to shut-in the well by closing the subsurface safety valve, or safety conditions such as fire dictate shutting-in the well, electrical power from the unit 45 through the line 44 and the electrical connector assembly of the invention is shut off deenergizing the solenoid 61 in the pilot valve assembly 55. The spring 60 shifts the pilot valve assembly to the open position illustrated in FIG. 2 so that fluid in the control line 41 may flow through the branch line 41*b* of the pilot valve assembly 55 and into the production tubing string 32 above the subsurface safety valve. The release of the control fluid pressure at the pilot valve directly into the tubing string 32 immediately lowers the pressure of the control fluid in the safety valve assembly 53 so that the spring 52 closes the subsurface safety valve 40 thereby shutting-in the well. The control fluid pressure in line 41 is dumped through the pilot valve into the production string above the safety valve.

To reopen the subsurface safety valve, the solenoid 61 is reenergized through the line 44 and the electrical connector assembly of the invention closing the valve assembly 55 of the pilot valve 43 and control fluid line pressure is reestablished in the line 41 through the filter 53*a* and the check valve 54 into the branch lines 41*a* and 41*b*. Since the pilot valve assembly 55 is now closed, the fluid cannot flow upwardly through the pilot valve into the production string 32. Thus, the control fluid pressure increases through the branch line 41*a* into the cylinder assembly 53 of the subsurface safety valve urging the piston of the cylinder assembly 53 to the left against the spring 52 reopening the valve assembly 51 of the safety valve so that production fluids may again flow upwardly in the production string 32

As will be understood in more detail hereinafter, in alternate embodiments of the invention the pilot valve may be operated by electromagnetic signals such as radio or acoustic signals transmitted down the well bore.

Figure 3A:
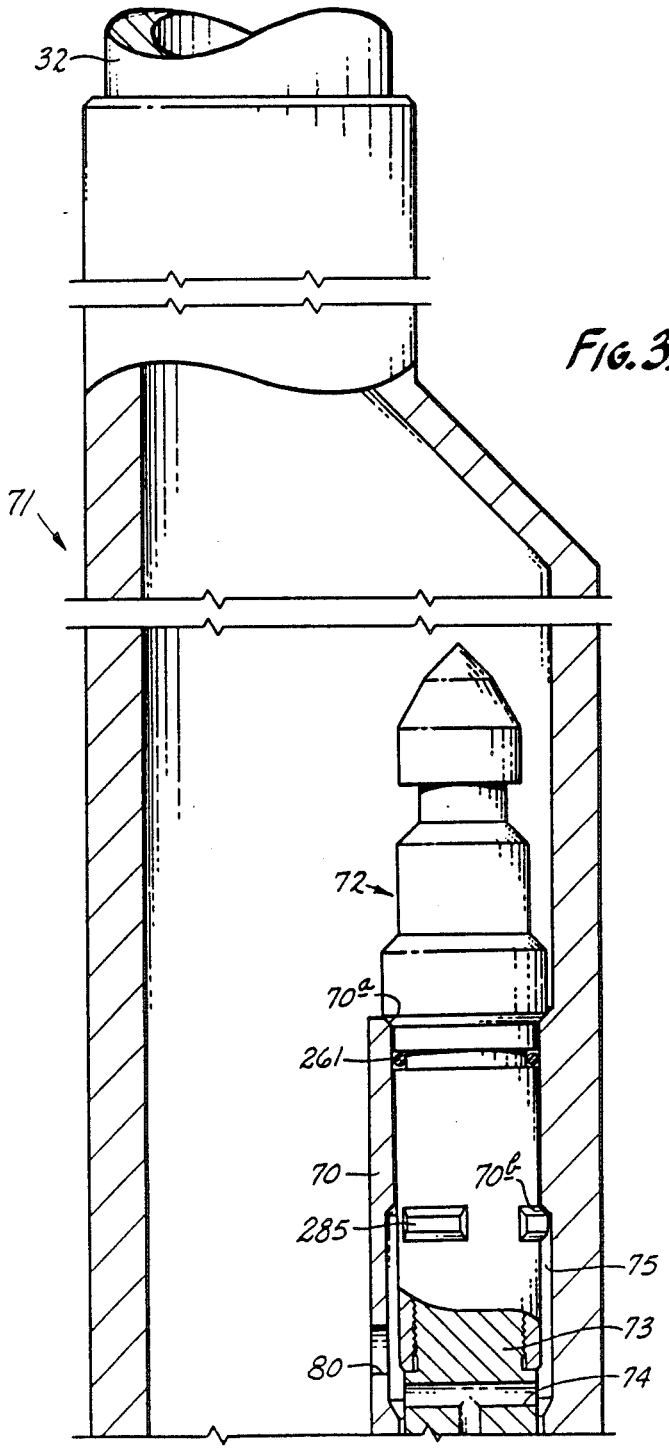
FIG. 3A, 3B, and 3C taken together form a longitudinal view in section and elevation of a side pocket mandrel having a wireline retrievable pilot valve for a subsurface safety valve in the well installation shown in FIGS. 1 and 2 including an electrical connector assembly in accordance with the invention.
Figure 3B:
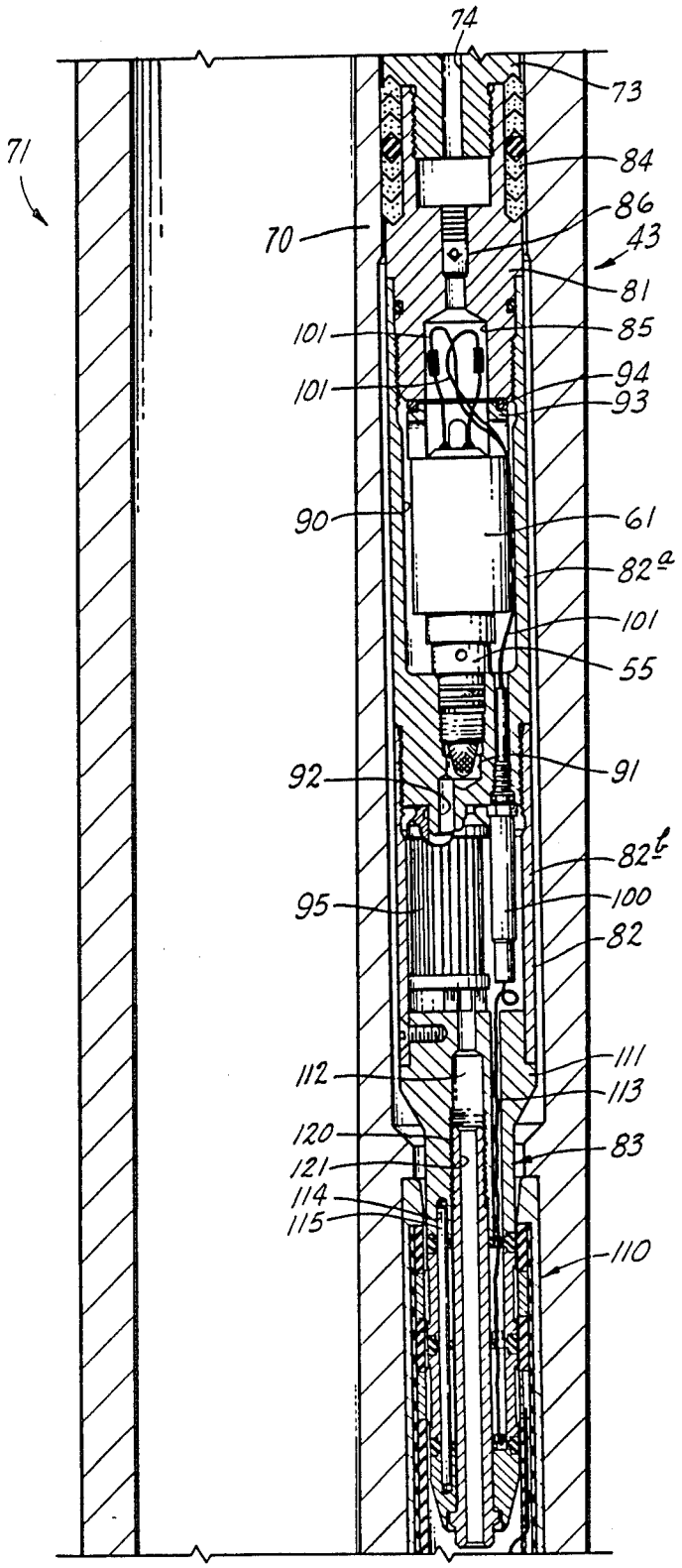
Figure 3C:
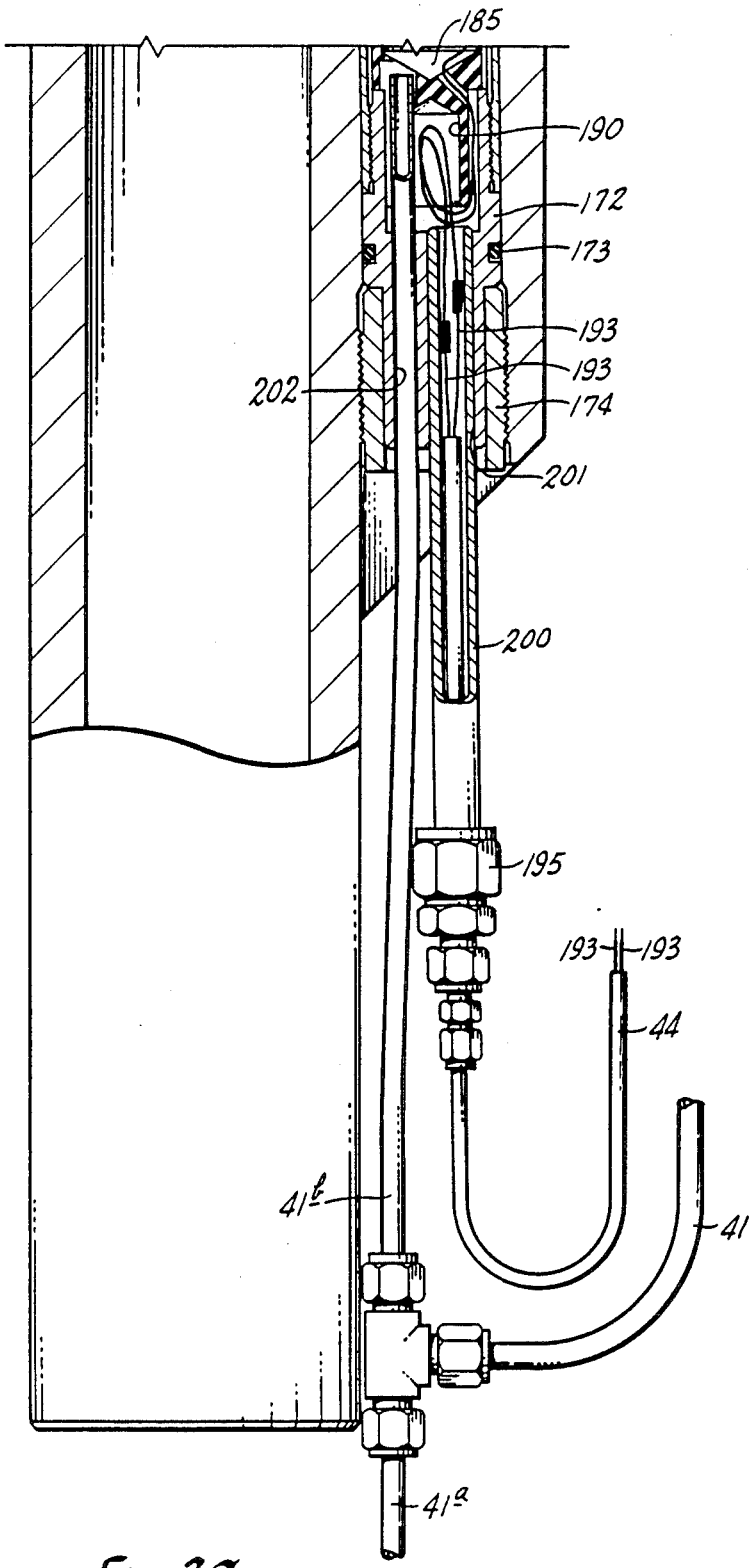

Referring to FIGS. 3A–3C inclusive, the electrically operated pilot valve 43 is releasably supported in a receptacle 70 of a side pocket mandrel 71 connected in the production tubing string 32. The pilot valve is releasably locked in the receptacle by a limited backlash latch assembly 72 connected with the pilot valve and operable by a wireline for running and pulling the pilot valve. The latch assembly 72 is connected with the pilot valve by a flow coupling 73 provided with a T-shaped flow passage 74 opening into an annulus 75 within the receptacle 70 communicating through side port 80 with the main bore through the side pocket mandrel 71. The flow passage 74 directs by-passed power fluid from the pilot valve through the coupling 73 to the side port 80 and into the bore of the side pocket mandrel.

Referring to FIG. 3B, the pilot valve 43 includes a top sub 81, the solenoid 61, the valve assembly 55, a central body 82, and an electrical plug contact assembly 83. The top sub is screwed on the lower end of the connector 73 and supports an external annular seal assembly 84 which seals around the pilot valve with the bore surface of the receptacle 70. The top sub has a central bore 85 providing a longitudinal flow passage through the sub into the flow passage 74 of the connector 73. A check valve 86 is secured in the reduced upper portion of the bore 85 to prevent backflow of fluids from the side pocket mandrel bore into the safety valve assembly. The lower end portion of the bore 85 is enlarged to accommodate electrical wiring connections to the solenoid 61. The central body portion of the pilot valve includes an upper section **82*a* and a lower section 82*b*. The upper section threads on the lower end of the top sub 81 and has a cylindrical chamber 90 which opens at a lower end to an internally threaded bore 91 communicating with a flow passage 92. The enlarged bore 90 accommodates the solenoid 61 and the valve assembly 55 which threads into the bore 91. An annular ported spacer 93 is positioned between the upper end of the solenoid 61 and the lower end of the top sub 81. An 0-ring 94 fits between the spacer and the lower end edge of the top sub to provide a downward bias to maintain the solenoid at a lower most position and absorb shock. The solenoid 61 fits in spaced relation within the bore 90 to provide an annulus for the electrical wiring to the solenoid and fluid flow around the solenoid into top sub bore 85. The lower body section 82*b* screws on the lower end of the upper body section 82*a* and is fitted along a lower end portion on the upper end portion of the plug assembly 83. A filter 95 is fitted within the housing section 82*b* between the upper end of the plug 83 and the lower end of the body section 82*a* to filter fluids flowing into the bore 92 of the upper body section and into the bore portion 91 into the valve assembly 55 to protect the valve from abrasives. Two circumferentially spaced, longitudinal, electrical wire feed-through assemblies 100 are disposed within the bore of the lower housing section 82*b* threaded along upper ends into the lower end of the upper body section 82*a* each to accommodate a wire 101 leading to the solenoid 61**.

The valve assembly 55 and solenoid 61 of the pilot valve 43 is an available product manufactured by Sterer Manufacturing Company, 4690 Colorado Blvd., Los Angeles, Calif. 90039 under the part number 70109-1. The electrical wire feed-through connectors 100 also are standard available assemblies capable of functioning under high temperatures and pressures and manufactured and sold by Kemlon Products and Development, 6310 Sidney, Houston, Tex. 77021 under the trademark Duo-Seel and sold under the general product designation K-16BM. It will be recognized that other available solenoid operated valve assemblies and electrical wire feed-through connector systems may be used.

Figure 7:
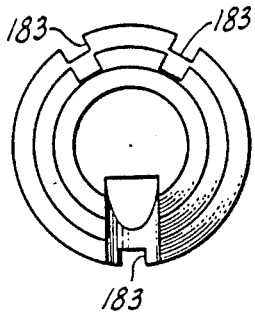
FIG. 7 is an end view of the wire guide of FIGS. 5 and 6.
Figure 8:
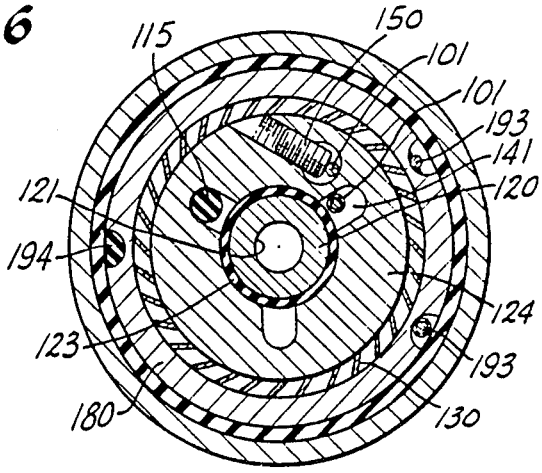
FIG. 8 is a view in section taken along the line 8—8 of FIG. 4.
Figure 10:
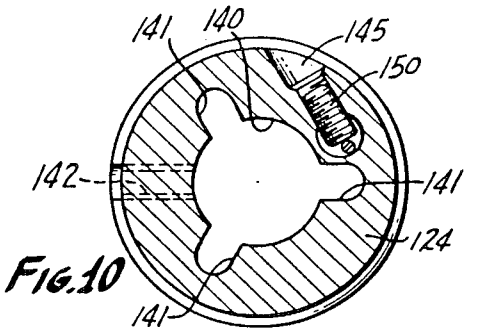
FIG. 10 is a view in section of the plug contact body as seen along the line 10—10 of FIG. 9.
Figure 9:
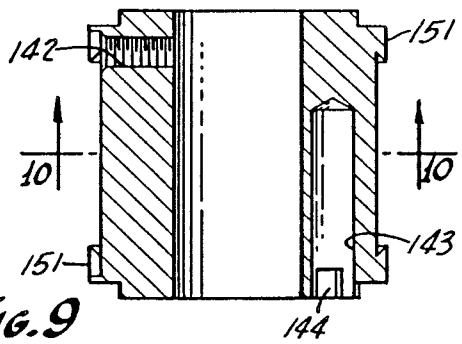
FIG. 9 is a longitudinal view in section of one of the electrical plug contact bodies of the pilot valve of FIGS. 3A–3C.
Figure 11:
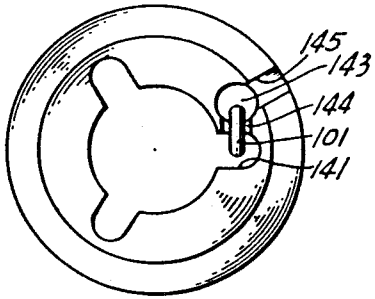
FIG. 11 is a right end view of the plug contact body as seen in FIG. 9.
Figure 12:
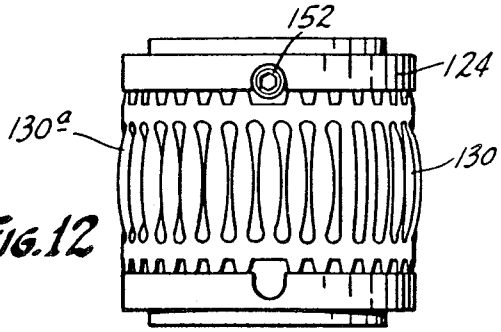
FIG. 12 is a side view in elevation of one of the contact rings of the pilot valve plug assembly mounted on the contact body of FIG. 9.
Figure 13:
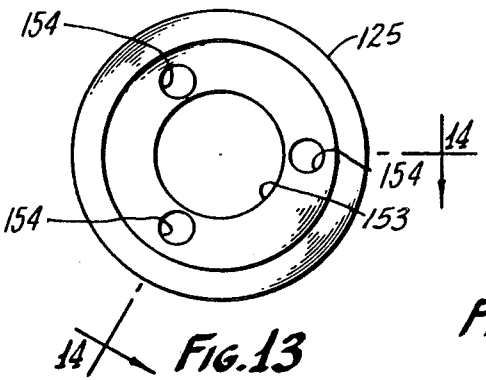
FIG. 13 is an end view of one of the insulators of the plug contact assembly of the pilot valve.
Figure 14:
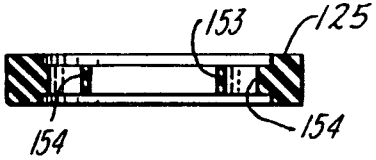
FIG. 14 is a view in section along the line 14—14 of FIG. 12.
Figure 16:
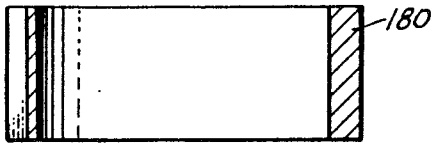
FIG. 16 is a view in section along the line 16—16 of FIG. 15.
Figure 15:
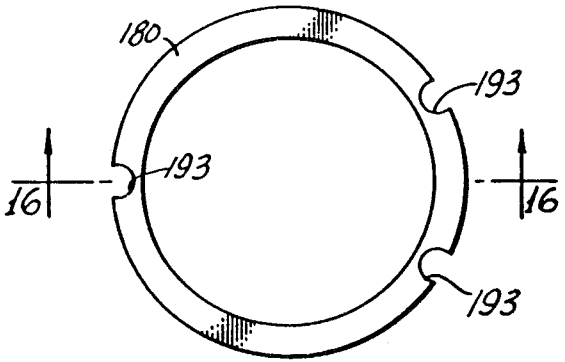
FIG. 15 is an end view in elevation of an insulated spacer for the receptacle contact assembly of the pilot valve.

The plug contact or electrical connector assembly 83 of the invention shown along the lower portion of FIG. 3B and in enlarged detail in FIGS. 4–14 inclusive, provides an insertable electrical male plug on the lower end of the wireline removable pilot valve. The plug assembly 83 provides electrical contact with an electrical female receptacle contact assembly 110 secured with and forming a part of the side pocket mandrel receptacle 70 in which the removable pilot valve fits. The plug 83 includes and is connected into the lower end of the body portion **82*b* by a plug mount 111 having a central bore 112 for fluid flow through the upper end of the plug assembly. The plug mount also has two circumferentially spaced bores 113 for the wires 101 and a downwardly opening blind bore 114 to accommodate the upper end of an alignment and anti-rotation rod 15 to properly align and maintain the alignment of the various components which make up the plug assembly 83. A tubular retaining screw 120 is threaded along an upper end portion into the internally threaded lower end portion of the bore 112 of the plug mount 111 to provide a flow passage through the bore 120 of the retaining screw into the bore 112 of the plug mount and to hold the various parts of the plug assembly 83 together. A tubular insulator sleeve 123 fits on the retaining screw 120 between the upper threaded portion of the screw and the flange 122. Two plug contact bodies 124 are mounted in tandem spaced relation along the insulator sleeve 123 between annular insulated rings 125. A longitudinally fluted contact ring 130 is mounted on each of the contact bodies 124. Design details of the contact bodies 124 are shown in FIGS. 9–11. FIG. 12 shows an assembly of one of the contact rings 130 mounted on a contact body 124. The details of the insulator rings 125 are shown in FIGS. 13 and 14. Referring to FIGS. 9–11, each of the contact bodies 124 is made of an electrically conductive material and provided with a central bore 140 sized to receive the insulator tube 123 and circumferentially spaced longitudinal slots 141 having a semi-cylindrical shape and opening into the bore 140. An internally threaded set screw bore 142 is provided for a set screw, not shown, for attaching the ring 130 to the body. Two of these slots 141 each accommodates one of the electrical wires 101 while the third slot 141 receives the alignment rod 115. A blind bore 143 is aligned with and spaced from one of the slots 141. A slot 144 is provided in an end face of the body 124 connecting the adjacent longitudinal slot 141 witb the blind bore 143 for securing one of the wires 101 in electrical contact with the body 124. As shown in FIG. 10 a lateral set screw bore 145 is provided for a set screw 150 into the blind bore 143 so that an end of the set screw may clamp an end of the wire 141 to the body 124 in the blind bore 143. As evident in FIG. 11 an end of the wire 101 is bent one hundred eighty degrees (180°) from the direction it extends in the slot 141 so that the end of the wire loops around into the bore 143 to be clamped to the body 124 by the set screw 150 to make good electrical contact therewith. External annular end flanges 151 retain the fluted contact ring 130 against longitudinal movement on the body 124. As evident in FIG. 12 the fluted contact ring 130 has a plurality of circumferentially spaced longitudinally extending spring-like contact portions 130*a*. The ring 130 is held against rotation on the body 124 by a set screw 152 threaded in the hole 142 of the body. The spring action of the ring portions 130*a* provide a tight electrical contact between the plug assembly 83 and the receptacle 110** for each of the wires 101. The insulator rings 125 each has a bore 153 for the insulator tube 123 and holes 154 which align with the body slots 141 for the alignment rod and for the wires 101. The insulator rings 125 and the insulator tube 123 electrically insulate the bodies 124 from each other and from the retaining screw 121 so that each of the bodies 124 may conduct electricity from the contact ring 130 to the wire 101 clamped to the body 124. A tubular nose member 160 fits on the tube 123 between the retaining screw flange 122 and the lower insulator ring 125 for holding the components of the plug 83 tightly together longitudinally when the retaining screw 120 is tightened. The nose member 160 has a central bore 161 sized to received the tube 123 and a blind upwardly opening hole 162 for the lower end of the alignment rod 115. It will be apparent that as the plug 83 is assembled the alignment rod 115 is inserted into the plug mount 111 at the upper end through the insulator rings 125 and the bodies 124 and into the plug nose 160 at the lower end to hold all such components against rotation when the plug is finally assembled and the wires 101 are connected with the bodies 124. As will be evident from FIG. 3B, two wires 101 are connected between the plug 83 and the solenoid 61. One wire is connected with each of the bodies 124 as described and illustrated in FIGS. 10 and 11. Each of the wires extends upwardly through separate holes and bores provided in the bodies 124 and the spacers 125. Each of the wires extends through one of the connectors 100 upwardly into the upper body section 82*a* around the solenoid 61 and into the upper end of the solenoid as illustrated in the upper portion of FIG. 3B.

Figure 4:
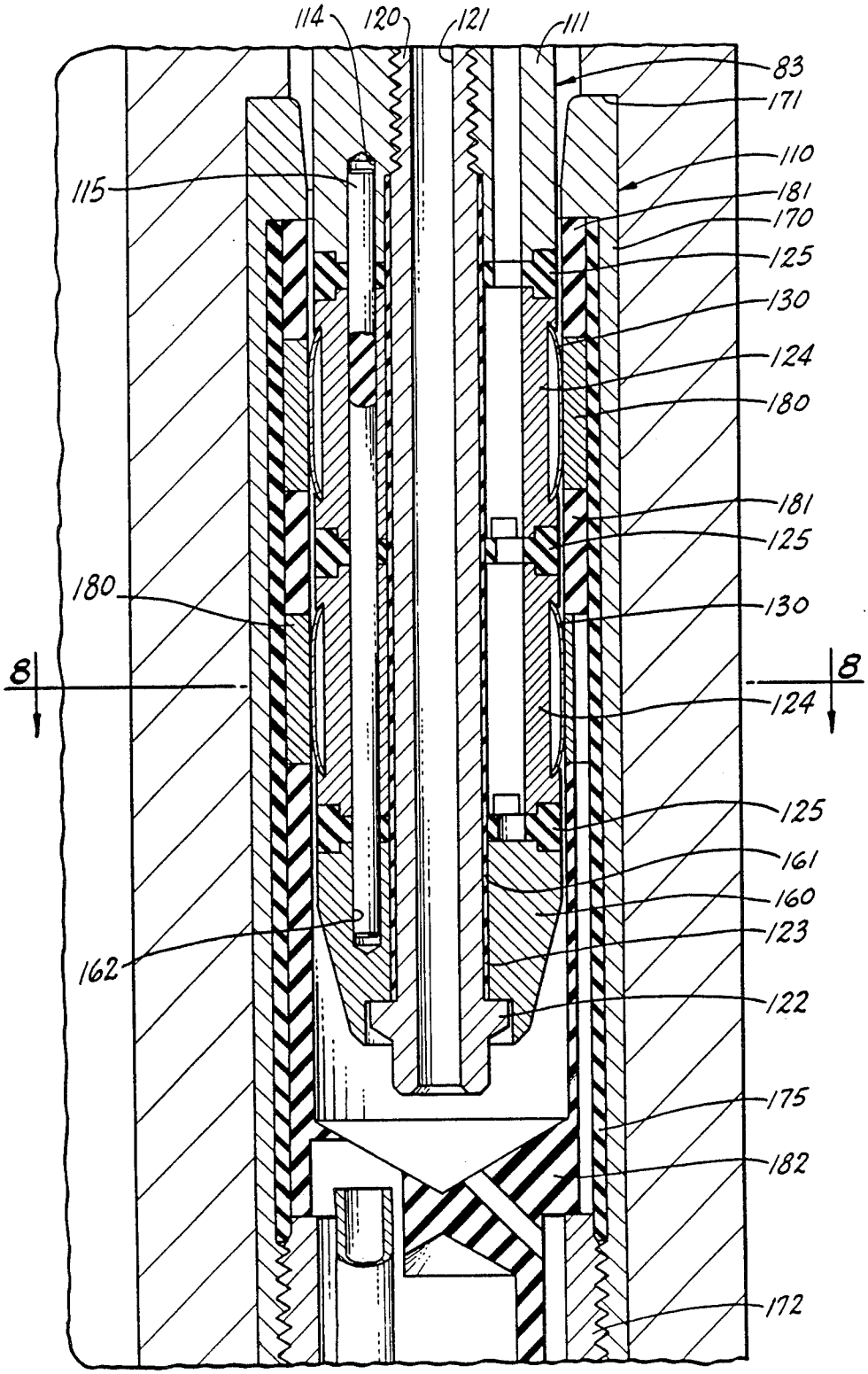
FIG. 4 is an enlarged fragmentary view in section and elevation of the electrical plug and receptacle contact assemblies of the invention as used in the pilot valve shown in FIG. 3B.
Figure 5:
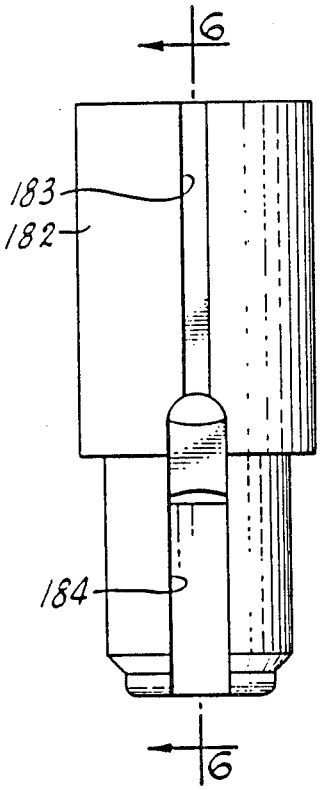
FIG. 5 is a longitudinal side view in elevation of the wire guide of the pilot valve receptacle illustrated along the upper portion of FIG. 3C.
Figure 6:
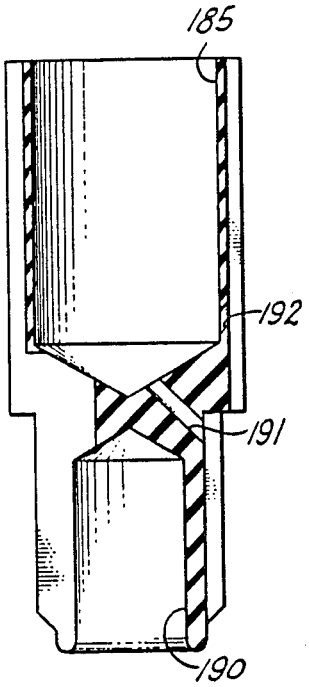
FIG. 6 is a longitudinal view in section and elevation of the wire guide of FIG. 5 taken along the line 6—6.

The side pocket mandrel receptacle electrical contact assembly 110 of the invention is illustrated in detail in FIGS. 3B and 3C, FIG. 4, FIGS. 5–8, and FIGS. 15 and 16. The assembly 110 has a housing 170 which fits in a lower end portion of the bore through the side pocket mandrel receptacle 70 against the downwardly facing internal annular shoulder 171 around the receptacle bore. The housing 170 screws along the lower end portion on the upper end of a wire feed-through member 172 which carries an 0-ring seal 173 for sealing with the bore surface of the receptacle and is held in place by a retainer ring 174 threaded into the lower end of the receptacle bore as shown in FIG. 3C. An insulator sleeve 175 is positioned within the bore of the housing 170 held in place by the wire feed-through member 172. Electrical contact rings 180 are mounted in spaced relation within the sleeve 175 separated by insulator rings 181. The contact rings 180 are positioned longitudinally for engagement by the fluted rings 130 on the plug 83 when the pilot valve is installed in the side pocket mandrel. A wire guide body 182 is disposed within the bore of the insulating sleeve 175 between the wire feed through 172 and the lower contact ring 180. The wire guide body holds the two contact rings 180 and the insulating rings 181 within the sleeve 175 in the relationship shown in FIG. 4. Details of the structure of the wire guide 182 and the contact rings 180 are shown in FIGS. 5–7 and 15 and 16, respectively. Referring to FIGS. 5–7, the wire guide 182 is formed of an electrically insulating material and is provided with three circumferentially spaced longitudinal slots 183 one of which opens to deeper slot 184 which communicates at an upper end thereof as shown in FIG. 6 with an upwardly opening central bore 185 provided in the wire guide. The slot 184 also communicates with a downwardly opening central bore 190 of the wire guide. Two of the slots 183 communicate with angular side holes 191 and 192 in the guide. The hole 191 opens from the lower end portion of one of the slots 183 into the lower end of bore 185. The hole 192 opens from the bore 185 through the upper wall section of the guide into the slot 183. Each of the sets of slots 183 and the holes 191 and 192 provide a path for a wire 193 for providing electric power to the receptacle contact rings 180. The reduced lower end portion of the wire guide 182 is spaced within the wire feed-through 172 providing an annulus between the wire guide and the wire feed-through so that the two wires 193 may pass through the annulus upwardly through the holes 191 into the bore 185 and outwardly from the bore 185 in the holes 192 into the vertical slots 183 through which the wires extend to the two contact rings 180. One of the contact rings 180 is shown in detail in FIGS. 15 and 16. The ring is made of electrically conducting material and provided with external longitudinal half cylinder shaped slots 193 which are aligned circumferentially with the slots 183 of the wire guide 182. The insulator rings 181 are also provided with corresponding longitudinal half cylinder shaped slots, not shown, to accommodate the wires 193. In the assemblied relationship of the parts of the receptacle 110 as shown in FIGS. 3B and 3C and FIG. 4, the vertical slots in the wire guide 182 and the electrical contact rings 180 and the insulating rings 181 are all in alignment so that two of the wires 193 pass upwardly through the aligned slots as seen in FIG. 8. An upper end portion of one of the wires 193 is soldered or welded to one of the rings 180 as shown in FIG. 8. The other wire 193 extends to the other contact ring 180 to which it is also soldered or welded along an upper end portion. In the third set of aligned longitudinal slots along the wire guide 182 and the contact rings 180 and the insulating rings 181, a half-cylinder shaped alignment rod 194 is positioned to hold the components of the receptacle assembly 110 against rotation. As shown in FIG. 3C, the cable 44 from the surface includes the electrical wires 193 connected into the contact rings of the receptacle 110. The cable 44 is connected into a coupling 195 secured on a tube 200 which is connected along an upper end portion into a downwardly opening bore 201 of the wire feed through member 172 as shown in FIG. 3C. The branch line 41*b* of the hydraulic control fluid system connects along an upper end portion into a separate longitudinal bore 202 of the member 172 opening at an upper end into the slot 184 of the wire guide 182 so that the fluid flow in the branch line 41*b* passes into the bore 185 of the wire guide 182.

Figure 17:
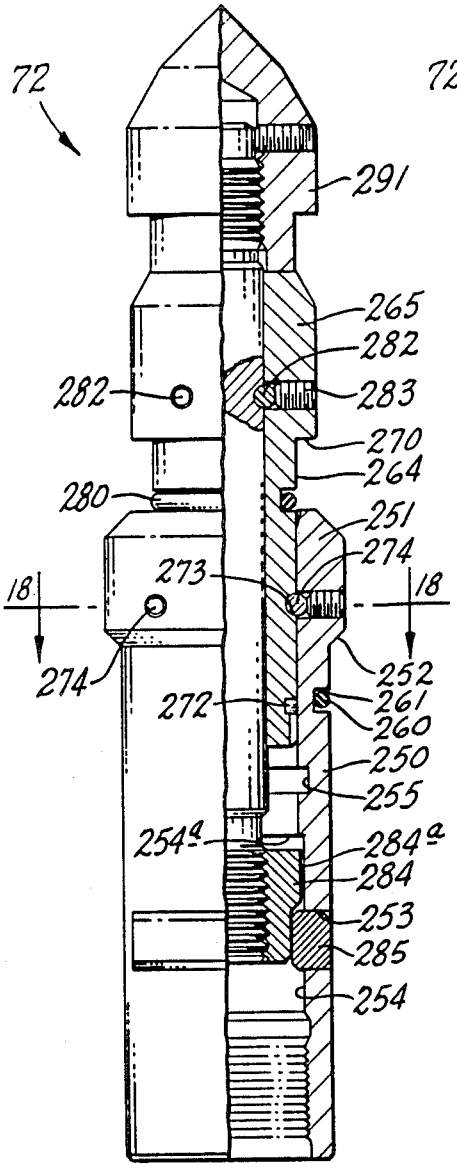
FIG. 17 is a longitudinal view in section and elevation of a latch assembly for releasably locking the pilot valve in a side pocket mandrel.
Figure 19:
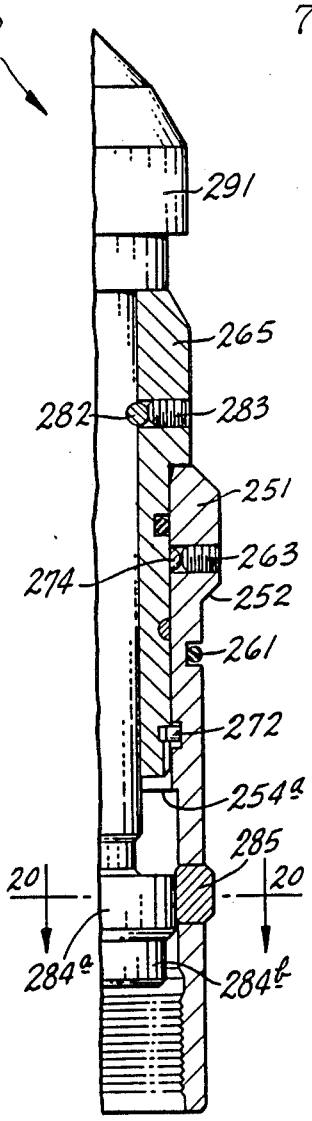
FIG. 19 is a fragmentary view in section and elevation of the latch assembly of FIG. 18 shifted to a locking condition.
Figure 20:
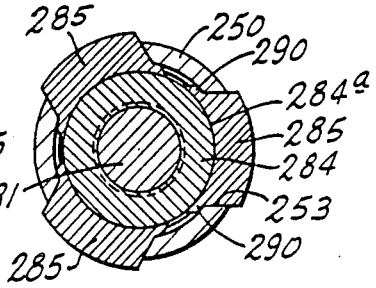
FIG. 20 is a view in section along the line 21—21 of FIG. 20.

Referring to FIGS. 17–20, the latch assembly 72 is a limited backlash latch assembly for wire-line operation to releasably lock the pilot valve 43 in the receptacle 70 of the side pocket mandrel 71. Latch assembly 72 can be used to install various types of well tools, particularly those which are useful in a side pocket mandrel, but is not limited to use with such side pocket mandrel tools or the pilot valve 43. The latch assembly 72 has a body 250 enlarged along an upper head portion 251 which is provided with a downwardly and inwardly sloping stop shoulder 252 which supports the latch assembly within the receptacle 70 of the side pocket mandrel. The body has circumferentially spaced windows 253, a longitudinal bore 254, and an internal annular snap ring recess 255 above the windows. The body has an external annular recess 260 for an 0-ring seal 261 to seal between the latch assembly body and the inner bore of the receptacle 70. The head portion 251 of the body has a pair of spaced transverse shear pin bores 262 extending perpendicular to and spaced from the longitudinal axis of the body. Internally threaded set screw holes 263 are provided in the body head portion 251 intersecting the shear pin bores 262. A tubular inner mandrel 264 is slidably disposed in the bore of the body 251 for movement between an upper running position as illustrated in FIG. 17 and a lower locking position shown in FIG. 19. The mandrel 264 has an enlarged head 265 providing a downwardly facing external annular stop shoulder 270 for engagement with the upper end of the head 251 of the body 250 limiting the downward movement of the inner mandrel in the body. A split snap ring 272 is mounted in an external annular recess along the lower end portion of the inner mandrel 264 for engagement in the latch ring recess 255 of the body when the inner mandrel is at the lower locking position of FIG. 19 and release position of FIG. 21. The inner mandrel has two laterally spaced half cylindrical lock pin recesses 273 each of which receives a shear pin 274 through the bores 262 of the body to releasably lock the inner mandrel at the running position shown in FIG. 17 within the body 250. Each of the shear pins 274 is held in place by a set screw 275 threaded through the bore 263 against the surface of the shear pin, FIG. 19. An O-ring seal 280 in an external annular recess on the inner mandrel 264 seals with the bore through the body 250 around the inner mandrel when the inner mandrel is at the locking and released positions of FIGS. 19 and 21. A core 281 fits in sliding relation through the bore of the inner mandrel 264. The core is held in the running and locking positions of FIGS. 17 and 19 by a pair of laterally spaced parallel shear pins 282 fitting through lateral shear pin recesses in the core and in the bores in the head 265 of the inner mandrel in the same relationship represented in FIG. 18 between the inner mandrel and the body. The shear pins 282 are each held in place by a set screw 283. A lug expander ring 284 is screwed on lower end portion of the core 281 to coact with circumferentially spaced locking lugs 285 mounted in the windows 253 of the body 250. The ring 284 has a graduated outside diameter providing an upper locking surface **284*a* and a lower release surface 284*b*. The lugs 285 are arcuate shaped as shown in FIG. 20 and have retaining ears 290 which keep the lugs from falling from the windows as apparent in FIG. 20. A handling head 291 is screwed on the upper end of the core. A set screw 292 is threaded through the head against the surface of the upper end portion of the core. The lower end edge of the head is engagable with upper end edge of the inner mandrel head 265 during the running of the latch assembly and when the latch assembly is locked in the side pocket mandrel receptacle as in FIGS. 17 and 19**.

Figure 21:
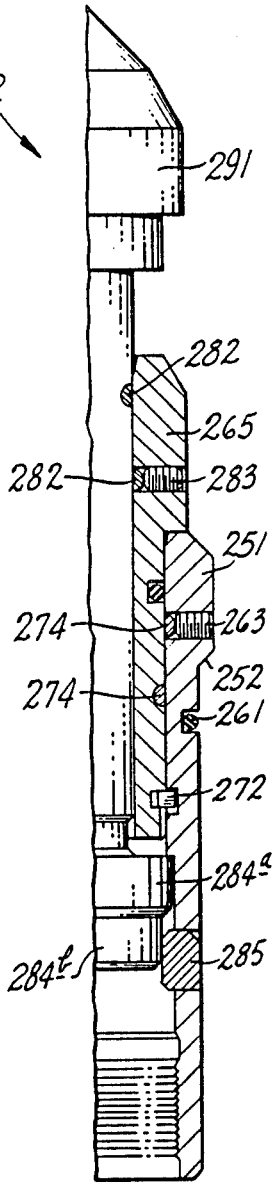
FIG. 21 is a fragmentary view in section and elevation of the latch assembly of FIG. 18 shifted to a release condition.
Figure 18:
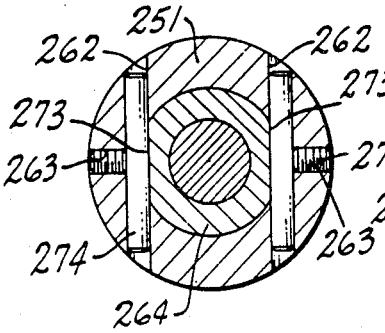
FIG. 18 is a view in section along the line 19—19 of FIG. 18.

The latch assembly 72 is connected with the pilot valve 43 as illustrated in FIG. 3A by threading the lower end of the latch assembly body 250 on the connector 73. Suitable wire-line handling tools are used to run and pull the latch assembly and pilot valve by grasping the head 291 of the latch assembly. The latch assembly releasably locks the pilot valve in the side pocket mandrel receptacle by engaging the stop shoulder 252 on the body 250 with the internal annular stop shoulder **70*a*, FIG. 3A, at the upper end of the side pocket mandrel receptacle 70. The expansion of the lugs 285 to the position shown in FIGS. 3A and 20 engages the lugs with internal annular locking shoulder 70*b* at the upper end of the recess 75 in the receptacle 70. During the running of the latch assembly and pilot valve the lug expander ring 284 is at the upper position shown in FIG. 17 being held by the shear pins 273 engaged between the inner mandrel 264 and the body 250 as represented in FIGS. 17 and 18. When the pilot valve and the latch assembly enter the receptacle bore and the shoulder 252 engages the receptacle shoulder 70*a*, a downward force is applied to the head of the latch assembly. The pins 274 are sheared releasing the inner mandrel 264 to move downwardly so that the inner mandrel and the core 281 are shifted to the lower locking position of FIG. 19. The shoulder 270 on the inner mandrel engages the upper end edge of the body head 251 limiting the downward movement of the inner mandrel in the body. The downward movement of the expander ring 284 within the lugs 285 moves the enlarged locking surface 284*a* of the expander ring behind the lugs expanding the lugs outwardly to the locking positions in the windows 253 as represented in FIGS. 19 and 3A. At the lower end position of the inner mandrel the snap ring 272 expands into the body locking recess 255 locking the inner mandrel at the lower end locking position of FIG. 20. The expanded locking positions of the lugs 285 is also shown in FIG. 21. When release of the latch assembly is desired to remove the pilot valve 43 from the side pocket mandrel receptacle, an upward force is applied on the head 291 of the latch assembly core. The pins 282 are sheared releasing the core to move upwardly to the position shown in FIG. 22 at which the reduced surface portion 284*b* on the lug expander ring is aligned with the inside faces of the lugs so that the lugs may move inwardly to the release positions of FIG. 22. The upper end edge of the ring 284 engages the internal annular stop shoulder 254*a* around the bore of the body 250 above the windows so that upward forces applied to the head are transmitted through the core to the ring 284 which lifts the body 250 with the lugs 285 upwardly. The shoulder 270 on the inner core head 265 is engaged by the upper end edge of the body so that the entire latch assembly 72 is lifted upwardly with the lugs 285 cammed inwardly to the release positions. The snap ring 272 remains engaged between the inner mandrel 264 and the body 250 as shown in FIGS. 20 and 22. Among the principal features of the latch assembly 72** is limited backlash during the operation of the latch assembly.

When the pilot valve 43 mounted on the latch assembly 72 is landed and locked in the side pocket mandrel receptacle 70 as illustrated in FIGS. 3A–3C, the pilot valve electrical plug assembly 83 is stabbed into the electrical receptacle assembly 110 in accordance with the invention as shown in FIG 3B. Limited backlash of latch assembly 72 is an important feature to maintain electrical contact between plug assembly 83 and receptacle assembly 110 and to minimize wear and damage which would result from relative movement. Electric power may then be applied from the surface through the cable 44 upwardly in the two wires 193 to the contact rings 180 of the receptacle assembly. From FIG. 4 it will be evident that the contact rings 180 are insulated from each other and from the housing 170 of the assembly. The contact ring assemblies 130 on the plug 82 engage the contact rings 180 by means of the spring sections **130*a* on the contact ring. The contact rings 130 are in electrical contact with the bodies 124 which are insulated from each other and from other metal parts of the plug assembly 82. Electric power from the bodies 124 is conducted through the wires 101 which extend through the connector 100 and upwardly into the member 81 to the solenoid 61. Application of electric power to the solenoid closes the normally open valve assembly 55 so that the power fluid flow may not occur upwardly through the pilot valve from the branch line 41***b* which connects with the main power fluid line 41 leading to the surface manifold 42 As shown in FIGS. 3C and 4, the upper end of the branch line 41*b* communicates through the wire guide 182 into the lower end of the bore 121 of the electric plug assembly 83. The power fluid communication continues upwardly through the bore 112 into the bore 92 into the valve 55 which is closed when the solenoid is energized. Power fluid through the branch line 41*a* is communicated downwardly to the safety valve 40 opening the safety valve. Deenergizing the solenoid by cutting off power from the surface to the solenoid, for any reason, such as if the safety valve is to be intentionally closed, or if a safety condition causes the electrical system to respond by cutting off power, the deenergized solenoid permits the valve assembly 55 to move to its normal fail-safe open condition. Power fluid communication is then established through the valve assembly 55 around the solenoid upwardly through the bore portion 85 in the member 81 and the bore 74 in the connector 73 and outwardly in the annulus 75 around the connection between the latch assembly 72 and the pilot valve. The power fluid flows outwardly through the port 80 into main bore through the side pocket mandrel thereby essentially instantly releasing power fluid pressure to the safety valve so that the safety valve will close in the normal manner. The signal which initiates closing the safety valve preferably also renders the surface unit 42 inoperative so that control fluid will not be pumped into the line 41 after the pilot valve opens. Since the pilot valve is electrically operated, the usual time required for the pressure signal change to be transmitted from the surface to the pilot valve is eliminated. The pilot valve and the safety valve do not have to react against the fluid flow resistance and hydrostatic pressure of the column of control fluid extending to the surface. The safety valve operating piston is opposed only by the small amount of power fluid present in the lines along the short distance between the safety valve and the pilot valve.

It will be apparent from the foregoing description and from the drawings that a pilot valve for operating a subsurface safety valve is provided which responds to energy communicated to the pilot valve through an electrical line and a connector assembly embodying the invention, to essentially instantly release hydraulic control fluid pressure to the subsurface safety valve to close the valve without the time delays inherent in the time required for a hydraulic pressure signal to reach the pilot valve and for the pressure responsive components of the safety and the pilot valves to lift a column of power fluid extending to the surface.

While particular preferred embodiments of the system of the invention have been described and illustrated, various changes may be made in the particular designs shown within the scope of the claims without departing from the invention.

What is claimed is:

1. An electrical connector assembly for electrical contact with a removable well tool in a well tubing comprising: housing means adapted for mounting in said well tubing: a plurality of longitudinally spaced insulated electrical contact rings mounted in said housing means; an insulator ring mounted in said housing means between each adjacent pair of said contact rings, each said insulator ring having longitudinal slots for electrical wires to said contact rings in said housing means; an electrical wire in said housing means to each said contact ring; a tubular member adapted to be connected on said well tool and defining a flow passage through said electrical connector assembly; a tubular insulator on said tubular member; a plurality of longitudinally spaced annular contact bodies on said tubular insulator each provided with longitudinal slots for electrical wires to each said contact body; an insulator ring on said tubular insulator between each adjacent pair of said contact bodies, said insulator rings on said tubular insulator being provided with slots for electrical wires; and electrical contact ring on each contact body sized and spaced to electrically contact each said contact ring in said housing means, each contact ring on each said contact body being a ring-shaped spring member formed of a plurality of interconnected circumferentially spaced longitudinal outwardly bowed spring-like contacts; and an electrical wire to each said contact ring on said tubular insulator.

2. An electrical connector assembly in accordance with claim 1 including a wire guide body connected with said housing means and having slots therein for electrical wires to said housing means contact rings.

3. An electrical connector assembly in accordance with claim 2 including a longitudinal alignment insulating rod through said annular contact bodies and insulator rings between said bodies to properly align said bodies and said insulator rings on said well tool.

4. An electrical connector assembly for coupling a removable well tool with a source of electrical power in well bore tubing comprising:

a tubular insulator sleeve adapted for mounting in a tubing:

a plurality of longitudinally spaced electrical contact rings in said insulator sleeve;

a tubular insulator ring within said insulator sleeve between each adjacent pair of said contact rings;

longitudinal slots in said contact rings and said insulator rings;

electrically conductive wire through said slots to said contact rings for conducting electricity to a well tool through said contact rings;

a tubular wire guide having a central longitudinal flow passage and separate longitudinal slots coupled and aligned with said contact rings including a tubular retainer having a central bore for fluid flow therethrough connectable with said tubular insulator sleeve;

a tubular retainer screw connectable with a well tool;

an insulator tube on said screw;

a plurality of tubulr electrically conductive contact bodies on said insulator tube longitudinally spaced along said tube;

an annular insulator ring on said insulator tube between each pair of adjacent contact bodies and at opposite ends of said bodies;

each of said contact bodies having an external annular mounting recess;

an electrical contact ring in each of said external recesses around each of contact bodies, each said contact ring being a spring-like member formed by a plurality of circumferentially spaced longitudinally extending outwardly bowed electrically conductive spring members, said contact rings being spaced and sized to electrically contact said electrically conductive contact rings in said tubular insulator sleeve when said contact rings on said retainer screw are inserted into said contact rings in said insulator sleeve with said contact rings on said retainer screw being aligned with and engaging said contact rings in said insulator sleeve;

said contact bodies and each said insulator ring on said insulator tube having longitudinal slots therein for electrical wires extending to said contact bodies for conducting electricity to said contact rings on said bodies; and a longitudinal insulating alignment rod through said contact bodies and each said annular insulator ring to properly align said bodies and each said annular insulator ring on said screw.

* * * * *